US007036857B2

(12) United States Patent
Ichino

(10) Patent No.: US 7,036,857 B2
(45) Date of Patent: May 2, 2006

(54) VEHICLE INSIDE DOOR HANDLE ASSEMBLY

(75) Inventor: Takehito Ichino, Novi, MI (US)

(73) Assignee: Nissan Technical Center North America, Inc., MI (US)

( * ) Notice: Subject to any disclaimer, the term of this patent is extended or adjusted under 35 U.S.C. 154(b) by 0 days.

(21) Appl. No.: 10/740,593

(22) Filed: Dec. 22, 2003

(65) Prior Publication Data

US 2005/0134059 A1 Jun. 23, 2005

(51) Int. Cl.
*E05B 1/00* (2006.01)

(52) U.S. Cl. ..... 292/347; 292/336.3; 292/DIG. 22

(58) Field of Classification Search ..... 292/336.3, 292/347, DIG. 22, DIG. 65; 16/412
See application file for complete search history.

(56) References Cited

U.S. PATENT DOCUMENTS 3,858,921 A * 1/1975 Kuki ..... 292/336.3
5,769,471 A * 6/1998 Suzuki et al. ..... 292/336.3
6,010,167 A * 1/2000 Tanimoto et al. ..... 292/336.3
6,070,923 A * 6/2000 Tanimoto et al. ..... 292/336.3
6,092,858 A * 7/2000 Bolwell ..... 296/146.7
6,167,779 B1 * 1/2001 Sano et al. ..... 74/543
6,554,331 B1 * 4/2003 Ciborowski et al. ..... 292/347
6,565,134 B1 * 5/2003 Stuart et al. ..... 292/336.3
6,575,508 B1 6/2003 Stuart et al.
6,719,336 B1 * 4/2004 Sato ..... 292/336.3

* cited by examiner

*Primary Examiner*—Gary Estremsky
(74) *Attorney, Agent, or Firm*—Shinjyu Global IP Counselors

(57) ABSTRACT

A vehicle inside door handle assembly has an inside door handle pivotally mounted to a mounting bracket. A biasing element is operatively disposed between the handle and the mounting bracket to urge the handle from a latch releasing position to a latching position. The handle has an operating portion and a counterweight portion. The counterweight portion is configured to counteract pivoting of the handle when a lateral force is applied to the handle in a plane substantially perpendicular to a pivot axis of the handle and substantially opposite to an urging force on the operating portion of the handle by the biasing element. The mounting bracket has an upper flange with an abutment surface disposed outwardly relative to the counterweight portion to prevent a door trim panel from being deflected against the counterweight portion of the handle.

23 Claims, 10 Drawing Sheets

VEHICLE INSIDE DOOR HANDLE ASSEMBLY

BACKGROUND OF THE INVENTION

1. Field of the Invention

The present invention generally relates to a vehicle inside door handle. More specifically, the present invention relates to a vehicle inside door handle including a counterweight that is configured to counteract pivoting of the vehicle inside door handle when a lateral force is applied to the vehicle inside door handle.

2. Background Information

Vehicles normally have an outside door handle and an inside door handle that are operatively coupled to a latch mechanism to latch or unlatch a door to a vehicle body. These door handles have many different configurations. The outside door handle is sometimes provided with a counterweight to ensure that the outside door handle is not moved by an inertial movement of the outside door handle. On the other hand, the inside door typically is not provided with such a counterweight.

In view of the above, it will be apparent to those skilled in the art from this disclosure that there exists a need for an improved vehicle inside door handle. This invention addresses this need in the art as well as other needs, which will become apparent to those skilled in the art from this disclosure.

SUMMARY OF THE INVENTION

It has been discovered that vehicle inside door handles with certain configurations may not properly maintain the door in a latching position against the inertial movement of the inside door handle.

One of the objects of the present invention is to provide a vehicle inside door handle that prevents an inertial movement of the inside door handle to ensure that the inside door handle remains in a latching position.

Foregoing object is basically attained by providing a vehicle inside door handle assembly comprising a mounting bracket, a handle and a biasing element. The mounting bracket is configured and dimensioned to be mounted within a vehicle door. The handle is pivotally mounted to the mounting bracket about a pivot axis between a latching position and a latch releasing position. The handle has an operating portion with a first mass disposed on a first side of the pivot axis and a counterweight portion with a second mass disposed on a second side of the pivot axis. The operating portion is configured and arranged relative to the mounting bracket to be operated from within a vehicle. The biasing element is operatively disposed between the handle and the mounting bracket to urge the handle from the latch releasing position to the latching position. The second mass of the counterweight portion is configured and arranged relative to the first mass of the handle to counteract pivoting of the handle when a lateral force is applied to the handle in a plane substantially perpendicular to the pivot axis and substantially opposite to an urging force by the biasing element on the operating portion of the handle.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1–4, a vehicle 10 is illustrated having a pair of front doors 12 (only one shown) that are each equipped with a vehicle inside door handle assembly 14 in accordance with the present invention. Since the focus of the present inventions is directed to the vehicle inside door handle assembly 14, the vehicle 10 and the doors 12 will not be discussed or illustrated in detail herein. Moreover, the right and left doors 12 are identical to each other, except that they are mirror images. Thus, only left or driver's side door will be discussed as needed to understand the present invention. The vehicle inside door handle assembly 14 is configured and arranged to operate a vehicle door latch mechanism (not shown) in a conventional manner via a cable 16.

Figure 1:
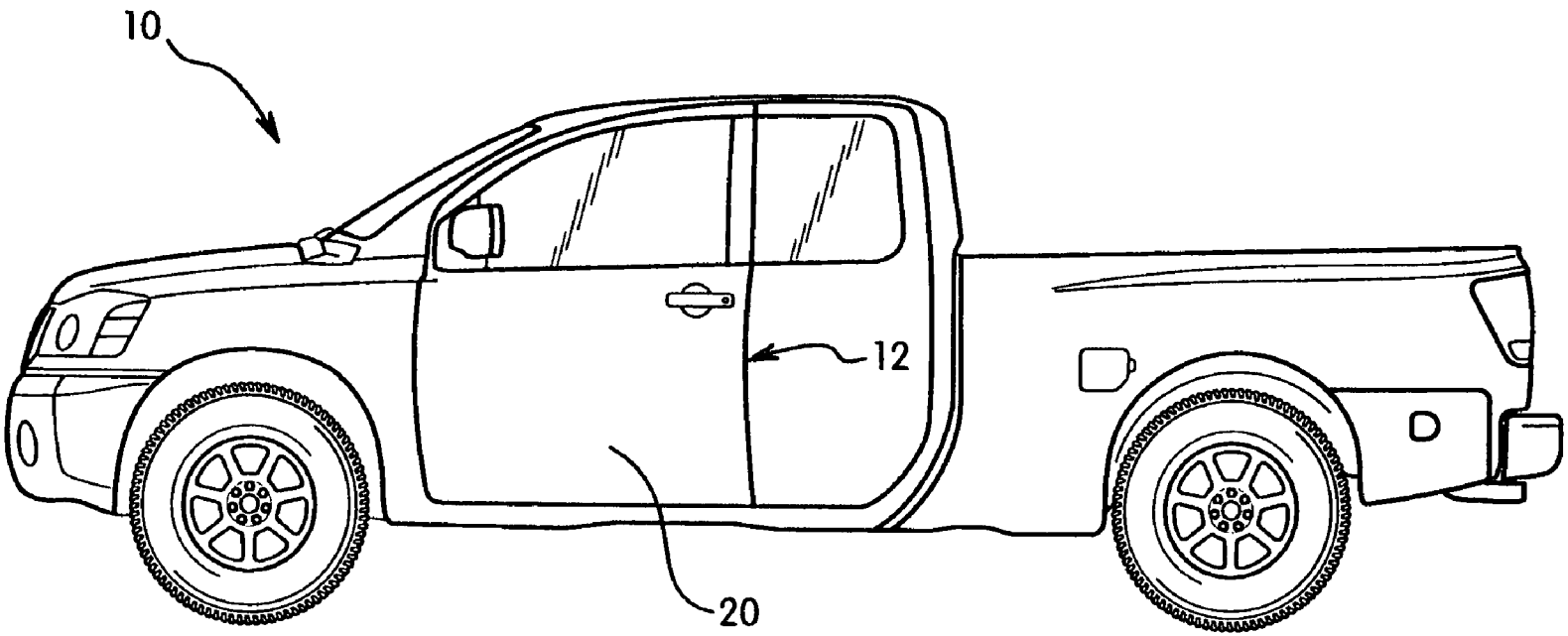
FIG. 1 is a side elevational view of a vehicle having a pair of front doors that are each equipped with a vehicle inside door handle assembly in accordance with the present invention.
Figure 2:
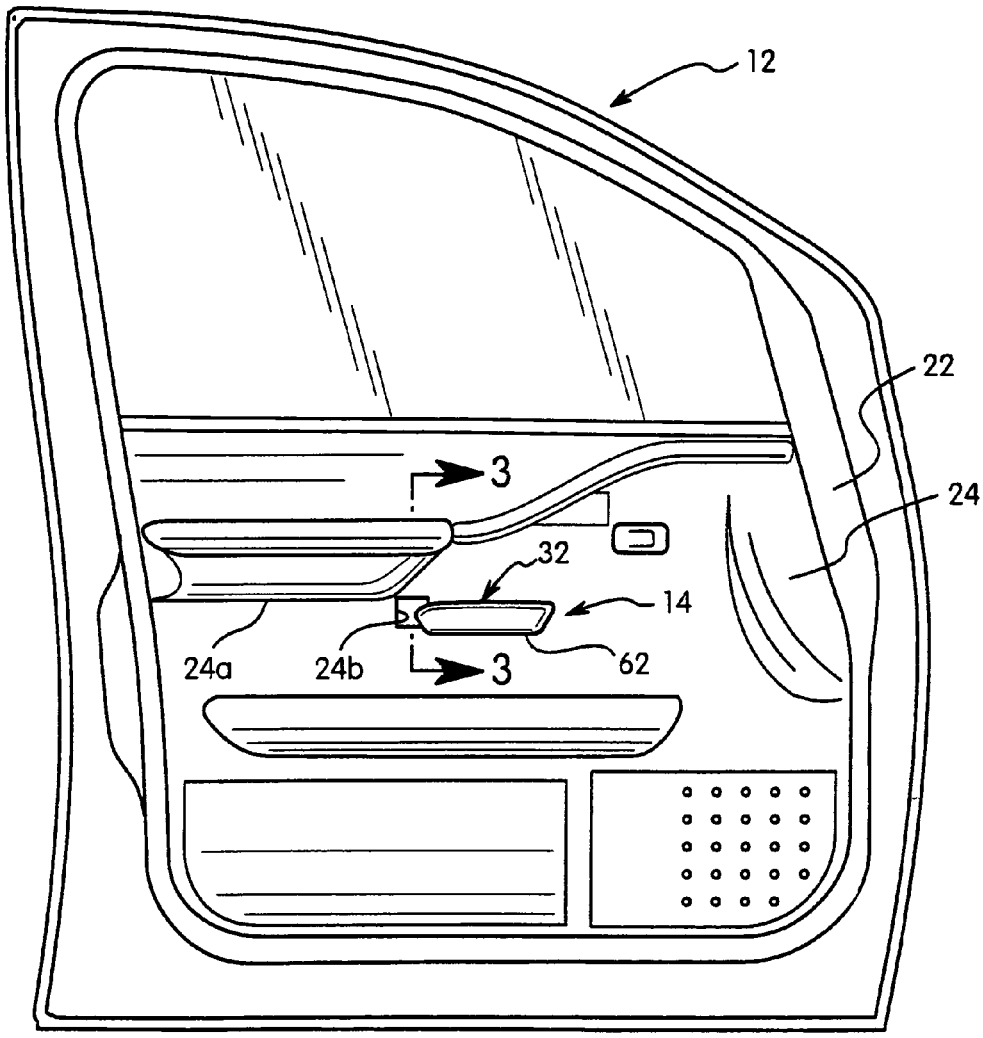
FIG. 2 is an interior side elevational view of the driver's side door of the vehicle illustrated in FIG. 1 that is equipped with the vehicle inside door handle assembly in accordance with the present invention.
Figure 3:
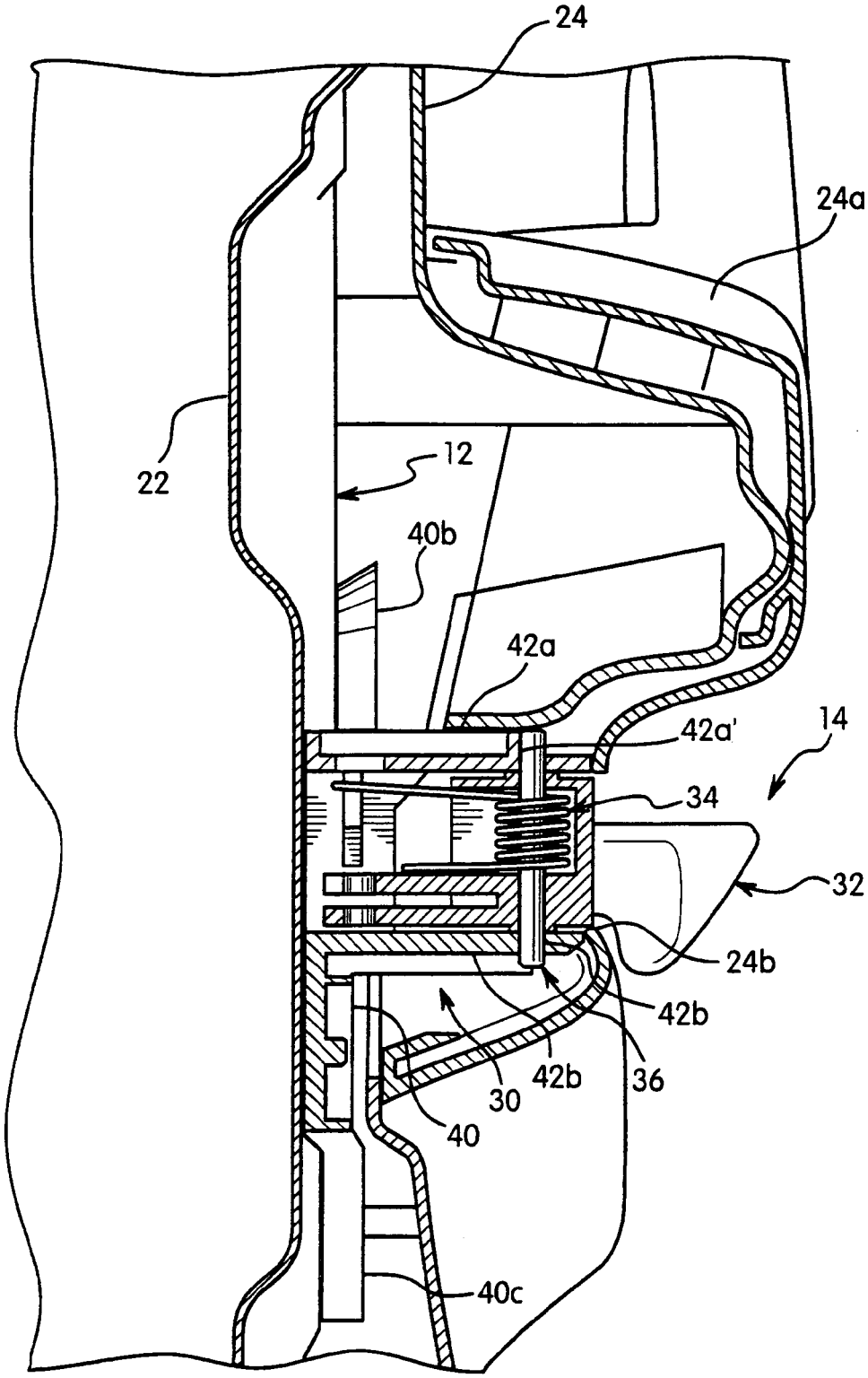
FIG. 3 is a simplified partial cross sectional view of a portion of the driver's side door illustrated in FIGS. 1 and 2 as seen along section line 3—3 of FIG. 2.
Figure 4:
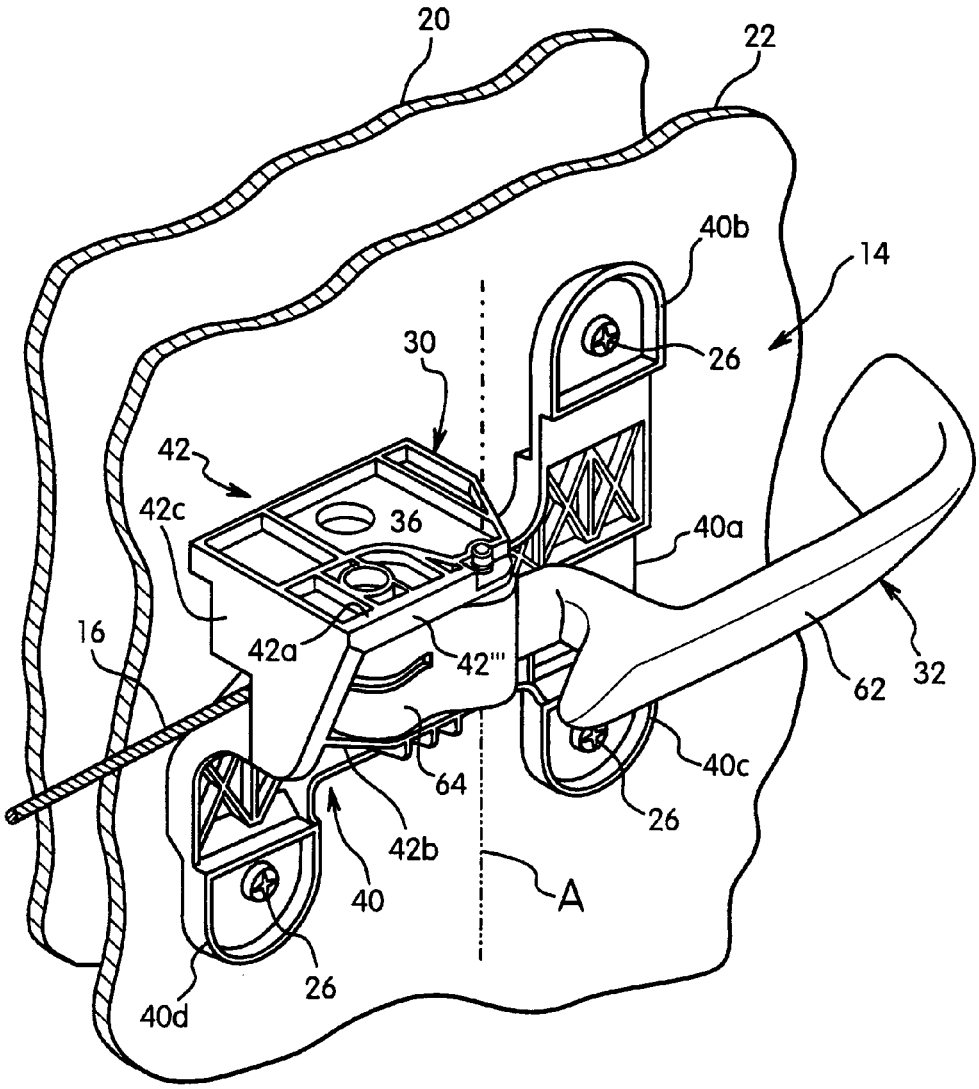
FIG. 4 is a partial perspective view of the driver's side door with the vehicle inside door handle assembly attached thereto in accordance with the present invention.
Figure 5:
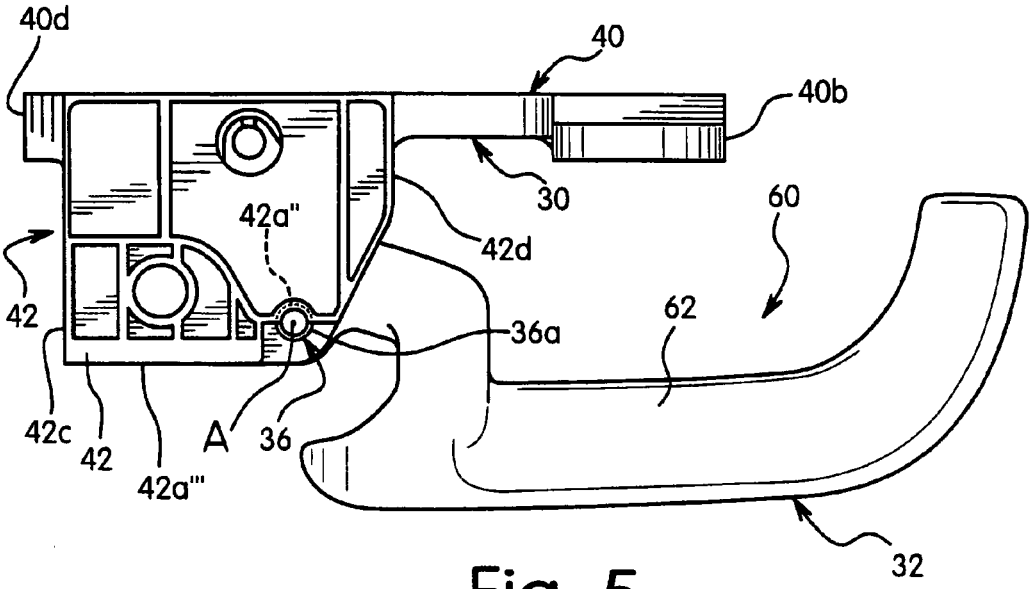
FIG. 5 is a top plan view of the vehicle inside door handle assembly in accordance with the present invention.

Basically, the vehicle door 12 has an outside door panel 20 and an inside door panel 22 that define the hollow interior for receiving various door elements and mechanisms that are well known in the art as best seen in FIG. 4. The inside door panel 22 has an interior door trim panel 24 coupled to the inside door panel 22 utilizing conventional fasteners such as clips (not shown). The door trim panel 24 is configured to conform to the shape of the inside door panel 22 and has a contoured shape. The door trim panel 24 is preferably constructed of a lightweight rigid material such as a rigid plastic material. Thus, the door trim panel 24, as seen in FIG. 3, is preferably molded to form the interior shape of the door 12. Preferably, the door trim panel 24 has an integrally formed arm rest 24*a* and an inside door handle opening 24*b* located beneath the arm rest 24*a*. As explained below, the vehicle inside door handle assembly 14 is configured and arranged to support the arm rest 24*a* of the door trim panel 24.

As seen in FIG. 4, the vehicle inside door handle assembly 14 is fixedly coupled to the inside door panel 22 via a plurality of fasteners such as fastening bolts 26. Thus, a first portion of the vehicle inside door handle assembly 12 is positioned between the inside door panel 22 and the door trim panel 24, while a second portion of the vehicle inside door handle assembly 14 protrudes outwardly through the handle opening 24*b* such that the vehicle inside door handle assembly 14 can be operated from the interior of the vehicle 10.

Referring now to FIGS. 4–8, the vehicle inside door handle assembly 14 basically includes a mounting bracket 30, a door handle 32 that is pivotally coupled to the mounting bracket 30, and a biasing element 34 that is operatively disposed between the door handle 32 and the mounting bracket 30 to urge the door handle 32 from a latch releasing position or an unlatching position to a latching (rest) position. Thus, the door handle 32 is normally urged by the biasing element 34 to a latching position. When the door handle 32 is operated, i.e., moved relative to the mounting bracket 30, the door handle 32 will pull the cable 16 to operate the latching mechanism of the door in a conventional manner. When the door handle 32 is released from the unlatching position, the door handle 32 will be urged back to the latching position by the biasing element 34 and the cable 16 will return to its original position.

The mounting bracket 30 is preferably constructed of a hard rigid material. For example, the mounting bracket 30 can be constructed of a hard rigid non-metallic material such as a hard rigid plastic material. Of course, other suitable materials can be utilized as needed or desired. The door handle 32 is mounted to the mounting bracket 30 by a rigid metal pivot pin 36. The mounting bracket 30 basically includes a door mounting portion 40 and a handle mounting portion 42 that are integrally formed together as a one-piece unitary member from a substantially hard, rigid material. For example, the mounting bracket 30 can be formed by injection molding using a hard rigid plastic material.

The door mounting portion 40 basically has a center section 40*a*, an upper attachment tab 40*b* and a pair of lower attachment tabs 40*c* and 40*d*. The upper attachment tab 40*b* has a fastener hole 40*b*', while the lower attachment tabs 40*c* and 40*d* have fastener holes 40*c*' and 40*d*', respectively. Thus, the mounting bracket 30 is fixedly secured to the inside door panel 22 via three conventional fasteners such as the fastening bolts 26 as seen in FIG. 4.

The handle mounting portion 42 is integrally formed at the top portion of the center section 40*a* of the door mounting portion 40. The handle mounting portion 42 has an upper flange 42*a*, a lower flange 42*b* and a pair of vertical walls 42*c* and 42*d* extending between the upper and lower flanges 42*a* and 42*b*. The lower flange 42*b* is arranged substantially parallel to the upper flange 42*a* to form a handle receiving space for receiving a portion of the door handle 32 therein as discussed below. Preferably, the upper and lower flanges 42*a* and 42*b* form a substantially U-shaped configuration with respect to the center section 40*a* of the door mounting portion 40.

The upper flange 42*a* has an upper pivot hole 42*a*', while the lower flange 42*b* has a lower pivot hole 42*b*'. The center axis of the upper and lower pivot holes 42*a*' and 42*b*' are aligned and defined a vertical pivot axis A for the door handle 32 as discussed later. Preferably, the upper flange 42*a* has a coupling groove 42*a*" that is formed adjacent to the upper pivot hole 42*a*' for retaining the pivot pin 36.

The upper flange 42*a* has a free end that forms a door trim abutment surface 42*a*'" that prevents the door trim panel 24 from being deflected against the portion of handle 32 that is located between the upper and lower flanges 42*a* and 42*b*. Preferably, the abutment surface 42*a*'" is a surface that lies in a plane that is substantially parallel to the mounting planes of the attachment tabs 40*b*, 40*c* and 40*d*. The upper surface of the upper flange 42*a* also forms a supporting surface for the door trim panel 24 as seen in FIG. 3. In other words, when the mounting bracket 30 is fixedly coupled to the inside door panel 22, and the door trim panel 24 is fastened to the inside door panel 22, then a downwardly facing surface or portion of the door trim panel 24 rest on the upper surface of the upper flange 42*a* to support the door trim panel 24 in the vertical direction. Preferably, a portion of the door trim panel 24 that forms the arm rest 24*a* rests on the upper surface of the upper flange 42*a*. Accordingly, when the occupant of the vehicle rest an arm on the arm rest 24*a* formed by the door trim panel 24, downward movement of the door trim panel 24 is resisted by the door trim panel 24 contacting the upper surface of the upper flange 42*a* of the mounting bracket 30.

Figure 6:
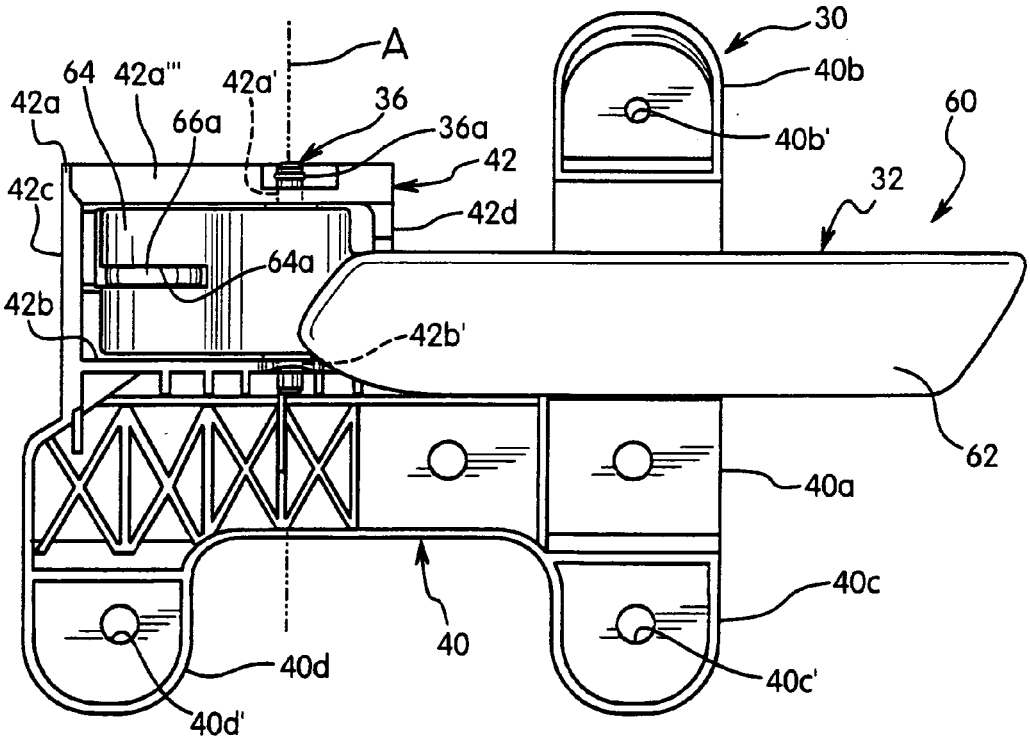
FIG. 6 is an interior side elevational view of the vehicle inside door handle assembly illustrated in FIGS. 4 and 5.
Figure 7:
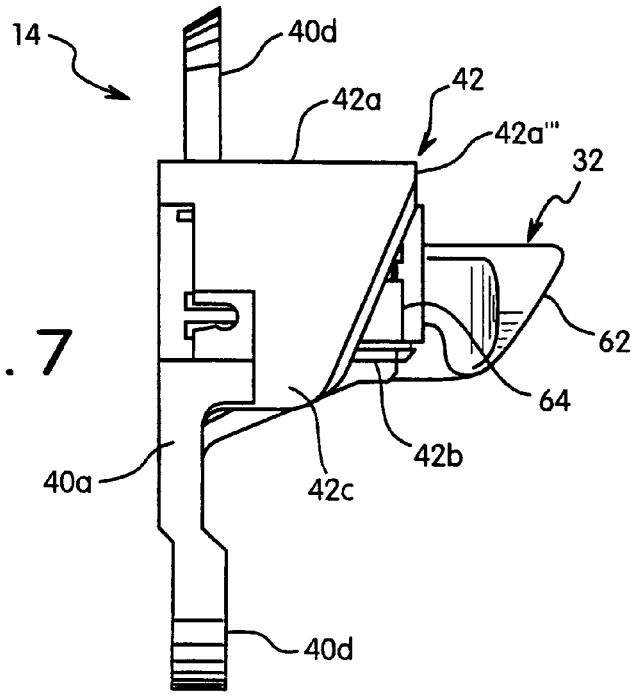
FIG. 7 is a rear side elevational view of the vehicle inside door handle assembly illustrated in FIGS. 4–6 in accordance with the present invention.
Figure 8:
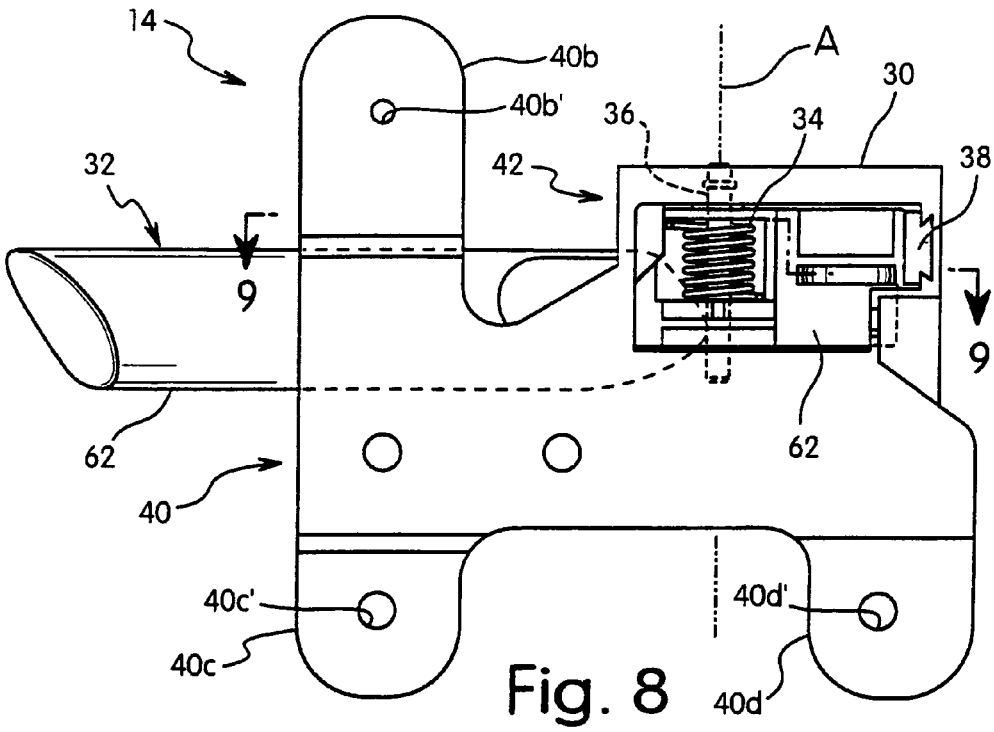
FIG. 8 is an exterior side elevational view of the vehicle inside door handle assembly illustrated in FIGS. 4–7 in accordance with the present invention.

The door handle 32 is pivotally mounted to the mounting bracket 30 by the pivot pin 36 for movement about the vertically arranged pivot axis A of the pivot pin 36 as best seen in FIGS. 6 and 8. When the door handle 32 is in the latching position, the door handle 32 abuts against a rubber stop member 38. Accordingly, the door handle 32 can be pivoted from the latching position to the unlatching position by pulling the door handle 32 relative to the mounting bracket 30 such that the door handle 32 pivots relative to the mounting bracket 30.

The pivot pin 36 is a hard rigid pin that is preferably constructed of a hard metallic material that is sized to be received in the upper and lower pivot holes 42*a*' and 42*b*' of the upper and lower flanges 42*a* and 42*b* of the mounting bracket 30. Preferably, the upper end of the pivot pin 36 has an annular rib 36*a* that is received in the coupling groove 42*a*" of the upper flange 42*a* of the mounting bracket 30 such that the pivot pin 36 is securely coupled to the mounting bracket 30. In particular, when the pivot pin 36 is inserted through the upper and lower pivot holes 42*a*' and 42*b*' of the mounting bracket 30, the rib 36*a* of the pivot pin 36 will snap into the coupling groove 42*a*" to securely fasten the door handle 32 to the mounting bracket 30 for pivotal movement.

Referring now to FIGS. 10–14, the mounting handle 32 has a main handle body 60 with an operating portion 62 and a counterweight portion 64. The counterweight portion 64 also includes a counterweight 66 that is fixedly retained in the main handle body 60. Preferably, the main handle body 60 is a one-piece unitary member that forms the operating portion 62 and at least the part of the counterweight portion 64 that retains the counterweight 66. Preferably, the main handle body 60 is constructed of a hard rigid material. For example, the main handle body 60 can be constructed of non-metallic material such as a hard rigid plastic material. The counterweight 66, on the other hand, is preferably constructed of a metal material. Thus, the operating portion 62 is defined by the portion of the main handle body 60 that is located on one side of the pivot pin 36, while the counterweight portion 64 is defined by the counterweight 66 and the portion of the main handle body 60 that is located on the other side of the pivot pin 36.

The operating portion 62 of the door handle 32 is configured such that when the mounting bracket 30 is secured between the inner door panel 22 and the door trim panel 24, the operating portion 62 projects outwardly through the handle opening 24*b* of the door trim panel 24. Thus, the operating portion 62 is configured and arranged such that the occupant can grasp the operating portion 62 and pivot it about the pivot axis A of the pivot pin 36. In other words, the door handle 32 is pulled in a horizontal plane away from the inside door panel 22 such that the counterweight portion 64 of the door handle 32 moves in a horizontal plane in a direction towards the inside door panel 22. Accordingly, the counterweight portion 64 is disposed in the recess formed between the upper and lower flanges 42*a* and 42*b* of the handle mounting portion 42 of the mounting bracket 30. The counterweight portion 64 and the handle mounting portion 42 are configured and arranged such that the counterweight portion 64 can move relative to the mounting bracket 30 within the recess formed between the upper and lower flanges 42*a* and 42*b* without hitting the inside door panel 22. The counterweight portion 64 and the handle mounting portion 42 are further configured and arranged such that forms the door trim abutment surface 42*a*'" prevents the door trim panel 24 from being deflected against the counterweight portion 64 of the handle 32. In other words, the upper flange 42*a* extends outwardly relative to the counterweight portion 64 in a direction towards the door trim panel 24.

The operating portion 62 has a first mass disposed on the first side of the pivot axis A of the pivot pin 36, while the counterweight portion 64 has a second mass disposed on the second side of the pivot axis A of the pivot pin 36. The first mass of the operating portion 62 is preferably less than or equal to the second mass of the counterweight portion 64 which includes the counterweight 66 and the portion of the main handle body 60 that is located on the opposite side of pivot axis A from the operating portion 62.

Figure 9:
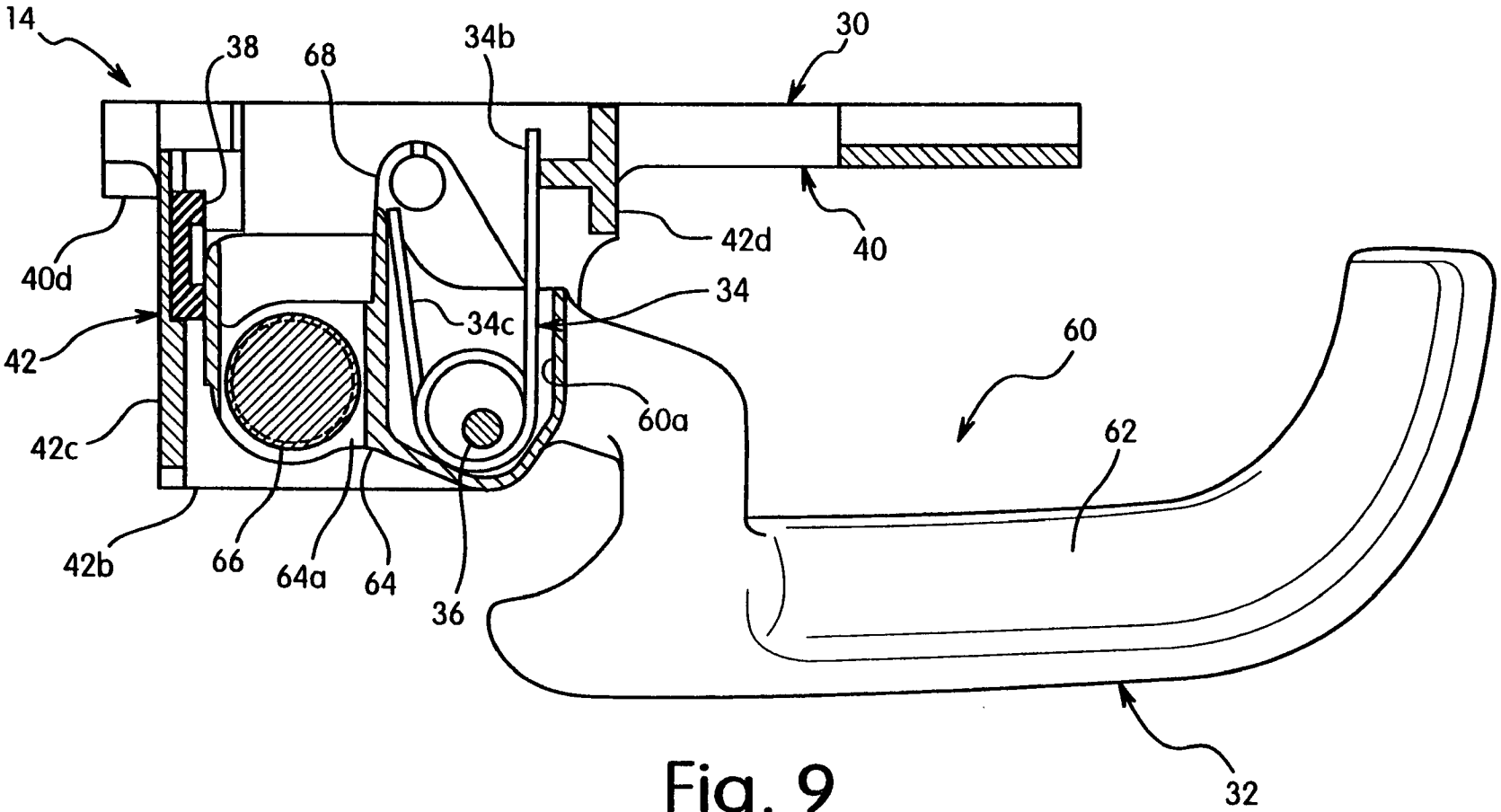
FIG. 9 is a cross sectional view of the vehicle inside door handle assembly as seen along section line 9—9 of FIG. 8.
Figure 10:
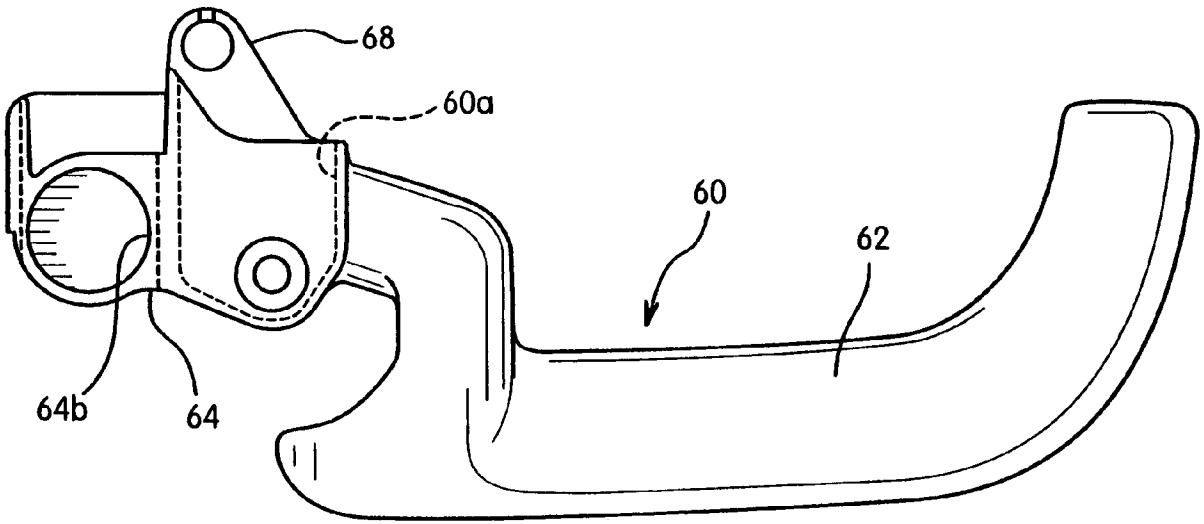
FIG. 10 is a top plan view of the door handle of the vehicle inside door handle assembly illustrated in FIGS. 4–9 in accordance with the present invention.
Figure 11:
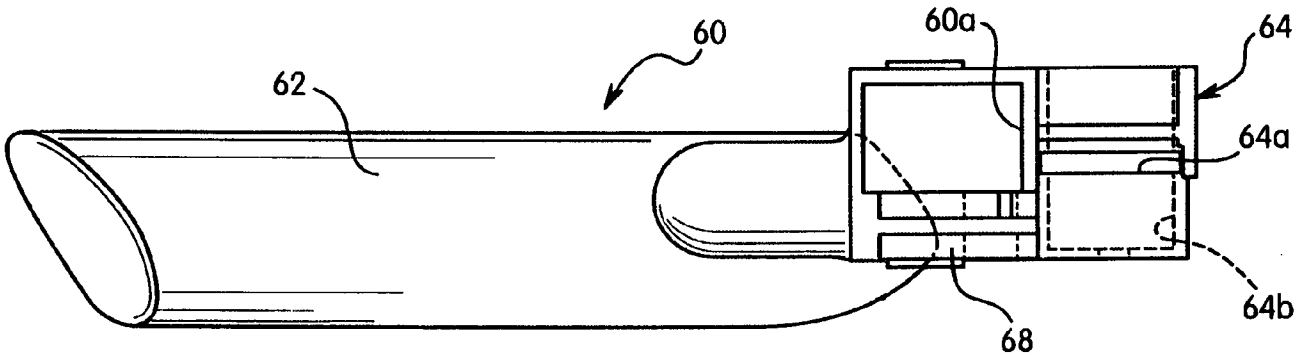
FIG. 11 is an exterior side elevational view of the door handle illustrated in FIG. 10 in accordance with the present invention.
Figure 12:
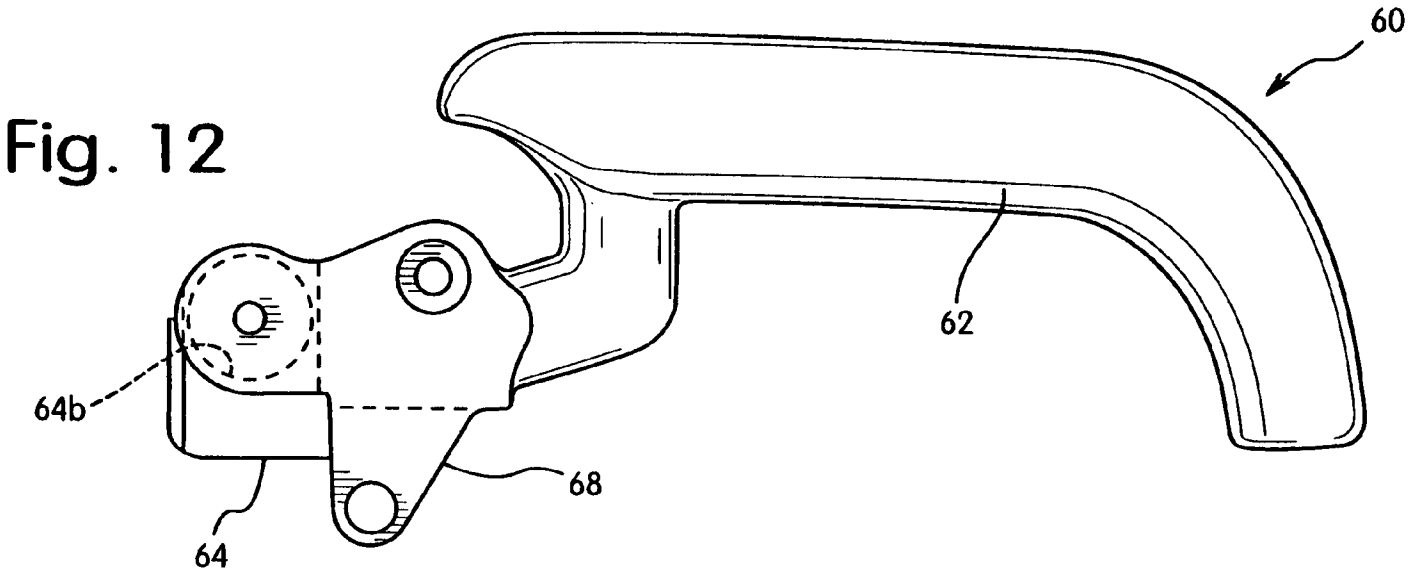
FIG. 12 is a bottom plan view of the door handle illustrated in FIGS. 10 and 11 in accordance with the present invention.
Figure 13:
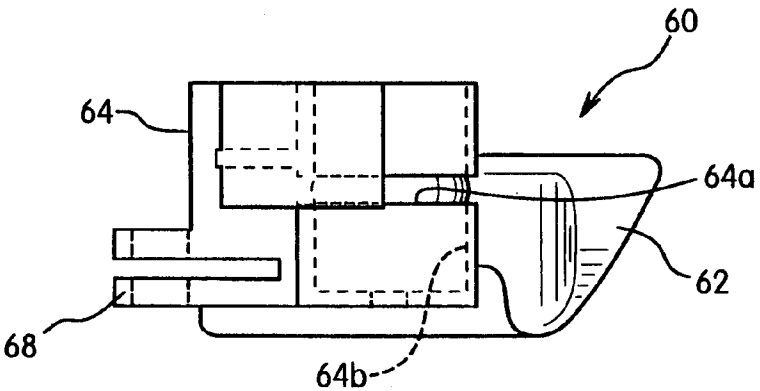
FIG. 13 is a rear end elevational view of the door handle illustrated in FIGS. 10–12 in accordance with the present invention.

As best seen in FIG. 9, a recess 60*a* is formed in the area of the pivot axis A between the operating portion 62 and the counterweight portion 64 for accommodating the biasing element 34. The counterweight portion 64 of the door handle 32 has a slot 64*a* and a recess 64*b* arrangement for accommodating and securing the counterweight 66 via a snap fit. The counterweight 66 is preferably a metal cylinder having an annular rib 66*a* that is designed to engage the slot 64*a* formed in the counterweight portion 64 of the main body 60 to retain the counterweight 66 in the recess 64*b* via a snap fit.

As best seen in FIGS. 10–13, a cable attachment structure 68 extends outwardly from the counterweight portion 64 for attaching the cable 16 to the door handle 32. The cable attachment structure 68 is configured and arranged to pull the cable when the door handle 32 is rotated from the latching position to the unlatching position. When the door handle 32 is in the latching position, the counterweight portion 64 of the door handle 32 contacts the rubber stop member 38 that is fixedly coupled to the vertical wall 42*c* that extends between the upper and lower flanges 42*a* and 42*b*.

Figure 14:
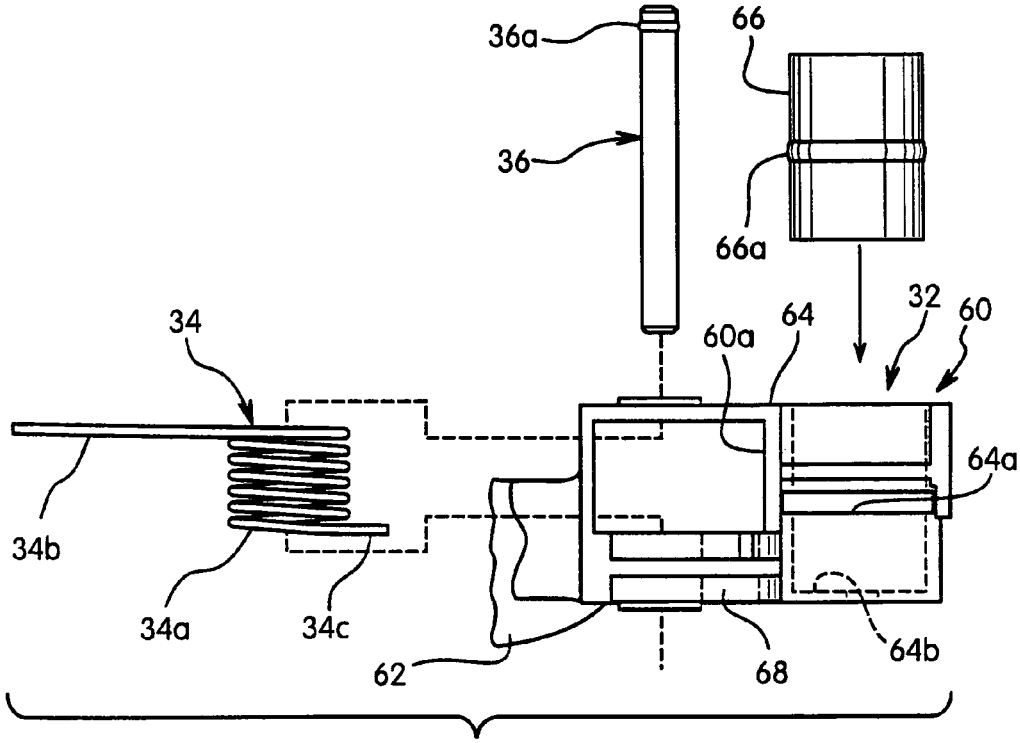
FIG. 14 is an exploded elevational view of the door handle illustrated in FIGS. 10–13 with selected parts exploded relative to the handle.
Figure 15:
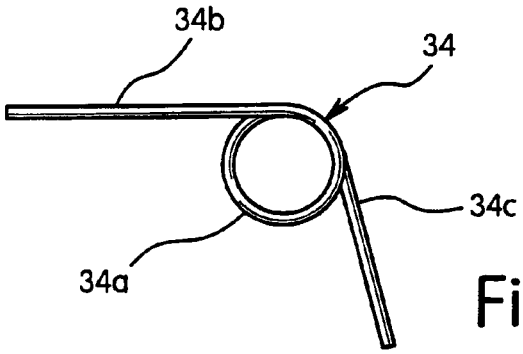
FIG. 15 is a top plan view of the biasing element or torsion spring in its unloaded state, i.e., prior to assembly in the vehicle inside door handle assembly in accordance with the present invention.

As best seen in FIGS. 9, 14 and 15, the biasing element 34 is preferably a torsion spring having a coiled portion 34*a*, a first end portion 34*b* and a second end portion 34*c*. The coiled portion 34*a* is preferably positioned around the pivot pin 36, while the first end portion 34*b* contacts the wall 42*d* of the mounting bracket 30 and the second end portion 34*c* contacts the counterweight portion 64 of the door handle 32. Accordingly, the door handle 32 is urged to the latching position by the biasing element 34 such that the counterweight portion 64 contacts the rubber stop member 38 located on the wall 42*c* of the mounting bracket 30.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A vehicle inside door handle assembly comprising:

a mounting bracket configured and dimensioned to be mounted within a vehicle door;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis, the operating portion being configured and arranged relative to the mounting bracket to be operated from within a vehicle; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket including a door mounting portion lying in a non-perpendicular mounting plane relative to the pivot axis, and a handle mounting portion lying in a substantially perpendicular plane to the pivot axis, the door mounting portion including first and second door attachment points located on the first and second sides of the pivot axis along the mounting plane, respectively, and the operating portion of the handle having a free end located further from the pivot axis than the first door attachment point as measured in a direction parallel to the mounting plane.

2. The vehicle inside door handle assembly according to claim 1, wherein the handle has a one-piece, unitary main handle body that forms the operating portion and at least part of the counterweight portion.

3. The vehicle inside door handle assembly according to claim 2, wherein the counterweight portion includes a counterweight fixedly coupled to the main handle body.

4. The vehicle inside door handle assembly according to claim 3, wherein the counterweight is constructed of a metallic material and the main handle body constructed of a non-metallic material.

5. The vehicle inside door handle assembly according to claim 1, wherein the door mounting portion includes a plurality of fastener holes that have center axes arranged in planes that are perpendicular to the pivot axis.

6. The vehicle inside door handle assembly according to claim 1, wherein the handle mounting portion includes an upper flange and a lower flange with the handle pivotally coupled between the upper and lower flanges to pivot about the pivot axis.

7. The vehicle inside door handle assembly according to claim 1, wherein the second attachment point is located at least as far away from the pivot axis as a center of the counterweight portion as measured in a direction parallel to the mounting plane.

8. A The vehicle inside door handle assembly comprising:

a mounting bracket configured and dimensioned to be mounted within a vehicle door;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis, the operating portion being configured and arranged relative to the mounting bracket to be operated from within a vehicle; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket including a door mounting portion lying in a non-perpendicular plane to the pivot axis, and a handle mounting portion lying in a substantially perpendicular plane to the pivot axis, the handle mounting portion includes an upper flange and a lower flange with the handle pivotally coupled between the upper and lower flanges to pivot about the pivot axis, one of the upper and lower flanges including an abutment surface configured and arranged to be disposed outwardly relative to the counterweight portion in a direction of an urging force by the biasing element on the counterweight portion of the handle and substantially perpendicular to a main longitudinal axis of the operating portion.

9. The vehicle inside door handle assembly according to claim 8, wherein the upper and lower flanges and the door mounting portion have a substantially U-shaped configuration with the counterweight portion being located within a recess defined by the substantially U-shaped configuration, and the abutment surface is spaced from the door mounting portion.

10. A vehicle inside door handle assembly comprising:

a mounting bracket configured and dimensioned to be mounted within a vehicle door;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis, the operating portion being configured and arranged relative to the mounting bracket to be operated from within a vehicle; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket including a door mounting portion lying in a non-perpendicular plane to the pivot axis, and a handle mounting portion lying in a substantially perpendicular plane to the pivot axis, the handle mounting portion includes an upper flange and a lower flange with the handle pivotally coupled between the upper and lower flanges to pivot about the pivot axis, the mounting bracket including an abutment surface configured and arranged to be disposed outwardly relative to the counterweight portion in a direction of an urging force by the biasing element on the counterweight portion of the handle and substantially perpendicular to a main longitudinal axis of the operating portion.

11. A vehicle door comprising:

a door body having an outside door panel and an inside door panel;

a door trim panel coupled to the inside door panel of the door body; and an inside door handle assembly including a mounting bracket mounted to the inside door panel of the door body;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket includes a door mounting portion lying in a non-perpendicular mounting plane relative to the pivot axis, and a handle mounting portion lying in a substantially perpendicular plane to the pivot axis, the door mounting portion including first and second attachment points located on the first and second sides of the pivot axis along the mounting plane, respectively, and the operating portion of the handle having a free end located further from the pivot axis than the first attachment point as measured in a direction parallel to the mounting plane.

12. The vehicle door according to claim 11, wherein the handle has a one-piece, unitary main handle body that forms the operating portion and at least part of the counterweight portion.

13. The vehicle door according to claim 12, wherein the counterweight portion includes a counterweight fixedly coupled to the main handle body.

14. The vehicle door according to claim 13, wherein the counterweight is constructed of a metallic material and the main handle body constructed of a non-metallic material.

15. The vehicle door according to claim 11, wherein the door mounting portion includes a plurality of fastener holes that have center axes arranged in planes that are perpendicular to the pivot axis.

16. The vehicle door according to claim 11, wherein the handle mounting portion includes an upper flange and a lower flange with the handle pivotally coupled between the upper and lower flanges to pivot about the pivot axis.

17. The vehicle door according to claim 11, wherein the second attachment point is located at least as far away from the pivot axis as a center of the counterweight portion as measured in a direction parallel to the mounting plane.

18. A vehicle door comprising:

a door body having an outside door panel and an inside door panel;

a door trim panel coupled to the inside door panel of the door body; and an inside door handle assembly including a mounting bracket mounted to the inside door panel of the door body, the mounting bracket including a handle mounting portion with an upper flange and a lower flange;

a handle pivotally mounted between the upper and lower flanges of the mounting bracket to pivot about a pivot axis between a latching position and a latch releasing position, the handle having an operating portion with a first mass disposed on a first side of the pivot axis and a counterweight portion with a second mass disposed between the upper and lower flanges on a second side of the pivot axis such that the upper and lower flanges lie in substantially perpendicular planes to the pivot axis and enclose a majority of the counterweight portion therebetween; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle.

19. A vehicle door comprising:

a door body having an outside door panel and an inside door panel;

a door trim panel coupled to the inside door panel of the door body; and an inside door handle assembly including a mounting bracket mounted to the inside door panel of the door body;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket including a handle mounting portion lying in a substantially perpendicular plane to the pivot axis, the handle mounting portion including an upper flange and a lower flange with the handle pivotally coupled between the upper and lower flanges to pivot about the pivot axis, one of the upper and lower flanges including an abutment surface that is configured and arranged to be disposed outwardly relative to the counterweight portion in a direction towards the door trim panel.

20. A vehicle door comprising:

a door body having an outside door panel and an inside door panel;

a door trim panel coupled to the inside door panel of the door body; and an inside door handle assembly including a mounting bracket fixedly mounted to the inside door panel of the door body;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis between the inside door panel and the door trim panel; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle, the mounting bracket including a stationary abutment surface protruding outwardly relative to the counterweight portion in a direction towards the door trim panel such that at least a portion of the abutment surface is arranged and configured to prevent a portion of the door trim panel directly opposed to the counterweight portion from contacting and moving the counterweight portion so that the handle remains in the latching position when the door trim panel is moved toward the counterweight portion.

21. The vehicle door according to claim 20, wherein the mounting bracket includes an upwardly facing support surface that is configured and arranged to support a downwardly facing surface of the door trim panel.

22. A vehicle door comprising:

a door body having an outside door panel and an inside door panel;

a door trim panel coupled to the inside door panel of the door body and having an arm rest; and an inside door handle assembly including a mounting bracket mounted to the inside door panel of the door body, the mounting bracket including an upwardly facing support surface located adjacent a downwardly facing surface of the arm rest of the door trim panel to limit downward deflection of the door trim panel;

a handle pivotally mounted to the mounting bracket about a pivot axis between a latching position and a latch releasing position, the handle having an operating portion with a first mass disposed on a first side of the pivot axis and a counterweight portion with a second mass disposed on a second side of the pivot axis; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the pivot axis and substantially opposite to an urging force by the biasing element on the operating portion of the handle.

23. A vehicle door comprising:

a door body having an outside door panel and an inside door panel;

a door trim panel coupled to the inside door panel of the door body; and an inside door handle assembly including a mounting bracket mounted to the inside door panel of the door body, the mounting bracket including a handle mounting portion having an upper flange and a lower flange;

a handle pivotally mounted between the upper and lower flanges of the mounting bracket to pivot about a vertical pivot axis between a latching position and a latch releasing position, the handle having an elongated operating portion with a first mass disposed on a first side of the vertical pivot axis and a counterweight portion with a second mass disposed between the upper and lower flanges on a second side of the vertical pivot axis such that the upper and lower flanges enclose a majority of the counterweight portion therebetween, the elongated operating portion having a vertical height and a horizontal length that is greater than the vertical height; and a biasing element operatively disposed between the handle and the mounting bracket to urge the handle from the latch releasing position to the latching position, the second mass of the counterweight portion being configured and arranged relative to the first mass of the handle to counteract pivoting of the handle when a lateral force is applied to the handle in a plane substantially perpendicular to the vertical pivot axis and substantially opposite to an urging force by the biasing element on the elongated operating portion of the handle.

* * * * *